US010697400B2

(12) United States Patent
Kawanishi et al.

(10) Patent No.: US 10,697,400 B2
(45) Date of Patent: Jun. 30, 2020

(54) EVAPORATIVE FUEL PROCESSING DEVICE AND FLUID PROCESSING DEVICE

(71) Applicant: HONDA MOTOR CO., LTD., Tokyo (JP)

(72) Inventors: Hiroshi Kawanishi, Wako (JP); Junji Saiga, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 114 days.

(21) Appl. No.: 16/175,410

(22) Filed: Oct. 30, 2018

(65) Prior Publication Data

US 2019/0128218 A1 May 2, 2019

(30) Foreign Application Priority Data

Nov. 2, 2017 (JP) ..... 2017-212629

(51) Int. Cl.
*F02M 25/08* (2006.01)
*F04F 5/20* (2006.01)
*F02M 35/10* (2006.01)

(52) U.S. Cl.
CPC ..... *F02M 25/089* (2013.01); *F02M 25/0854* (2013.01); *F02M 35/10222* (2013.01); *F04F 5/20* (2013.01)

(58) Field of Classification Search
CPC ..... F02M 25/089; F02M 25/0854; F02M 35/10222; F04F 5/20
See application file for complete search history.

(56) References Cited

U.S. PATENT DOCUMENTS

2019/0234294 A1* 8/2019 Sager ..... F02B 19/1004

FOREIGN PATENT DOCUMENTS

| | | | |
|---|---|---|---|
| JP | 63-162965 | U | 10/1988 |
| JP | 2006-226114 | A | 8/2006 |
| JP | 2016-079915 | A | 5/2016 |

OTHER PUBLICATIONS

Office Action dated Aug. 6, 2019, issued in counterpart JP Application No. 2017-212629, with English translation (8 pages).
Office Action dated May 21, 2019, issued in counterpart JP Application No. 2017-212629, with English translation (12 pages).

* cited by examiner

*Primary Examiner* — Xiao En Mo
(74) *Attorney, Agent, or Firm* — Westerman, Hattori, Daniels & Adrian, LLP

(57) ABSTRACT

A pump flow passage 52 which extends in a flow direction F1 and through which fluids introduced through first and second inlet pipe 62, 79 flow is disposed inside a main body 51 of a purge pump 5 of an evaporative fuel processing device, a venturi 53 which decreases in diameter toward downstream is formed in the pump flow passage 52 at a position downstream of the first inlet pipe 62 in the flow direction F1, the main body 51 has an upstream-side member 6 in which the first inlet pipe 62 is disposed, and a downstream-side member 8 in which a discharge pipe 81 is disposed, and connection faces 74, 87 of the upstream-side member 6 and the downstream-side member 8 are disposed upstream of the smallest diameter part 55, at which the inner diameter of the venturi 53 is the smallest, in the flow direction F1.

10 Claims, 7 Drawing Sheets

EVAPORATIVE FUEL PROCESSING DEVICE AND FLUID PROCESSING DEVICE

CROSS-REFERENCE TO RELATED APPLICATION

This application claims priority of Japanese Patent Application No. 2017-212629 filed in Japan on Nov. 2, 2017, the entire contents of which are incorporated herein by reference.

TECHNICAL FIELD

The present invention relates to an evaporative fuel processing device and a fluid processing device.

BACKGROUND OF THE INVENTION

A vehicle with a fuel tank is equipped with an evaporative fuel processing device which is configured to process evaporative fuel generated in this fuel tank. An existing evaporative fuel processing device makes evaporative fuel, generated in the fuel tank, absorbed by an activated carbon in a canister, purges the evaporative fuel, absorbed by the activated carbon, with the fresh air by use of negative pressure generated in an intake pipe, and introduce it into the intake pipe to combust it in an engine. However, in the case where the intake pipe is provided with a compressor of a supercharger, a part downstream of this compressor becomes positive pressure during supercharging, and therefore it is not possible to purge evaporative fuel, absorbed by the activated carbon, by use of negative pressure.

To cope with this, an evaporative fuel processing device described in Japanese Utility Model Registration Application Publication No. Sho 63-152965 is provided with a purge pump (more specifically a venturi) in a passage through which the downstream side and the upstream side of a compressor communicate with each other, and connects the purge pump and a canister to each other with a purge passage. During supercharging, a part downstream of the compressor becomes a higher pressure than apart upstream of the compressor, and thus the air flows from the downstream side to the upstream side of the compressor in the passage through which these parts communicate with each other. This flow of the air generates negative pressure in the purge pump, which makes it possible to purge evaporative fuel, absorbed by an activated carbon in the canister, even during supercharging.

Meanwhile, in the evaporative fuel processing device described above, the purge pump is secured on an intake pipe with screws and bolts etc., but they are sometimes detached or broken unintentionally due to various reasons such as vibration of the vehicle and failing to fasten them during maintenance. However, in the existing evaporative fuel processing device, the air flows in the purge pump from the downstream side of the compressor toward the atmosphere even when the purge pump is detached from the intake pipe, and therefore negative pressure is generated and the evaporative fuel absorbed by the activated carbon might flow out to the atmosphere.

There is a need to provide an evaporative fuel processing device and a fluid processing device capable of inhibiting evaporative fuel from flowing out even when an anomaly occurs in a purge pump.

SUMMARY OF INVENTION (1) An evaporative fuel processing device (an evaporative fuel processing device 2B to be described later, for example) of the present invention is characterized by including: a purge pump (a purge pump 5B to be described later, for example) which is a cylindrical body (a main body 51B to be described later, for example) having a discharge part (a discharge pipe 81B to be described later, for example) that communicates with an intake passage (an intake pipe 4 to be described later, for example) of an internal combustion engine at a position upstream of a supercharger (a supercharger 93 to be described later, for example), a first inlet part (a first inlet pipe 62 to be described later, for example), and a second inlet part (a second inlet pipe 79 to be described later, for example), and designed to discharge a fluid, introduced through the first and second inlet parts, into the intake passage through the discharge part; a bypass passage (a bypass pipe 35 to be described later, for example) through which a part of the intake passage downstream of the supercharger and the first inlet part communicate with each other; and a purge passage (a first purge pipe 33 and a second purge pipe 36 to be described later, for example) through which a canister (a canister 32 to be described later, for example) that has an absorbing agent designed to absorb evaporative fuel and the second inlet part communicate with each other, the evaporative fuel processing device being characterized in that a pump flow passage (a pump flow passage 52 to be described later, for example) which extends in a flow direction where a fluid introduced through the first inlet part flows and through which a fluid introduced through the first inlet part and a fluid introduced through the second inlet part flow is disposed inside the cylindrical body, a narrowing down part (a venturi 53 to be described later, for example) which decreases in diameter toward downstream is formed in the pump flow passage at a position downstream of the first inlet part in the flow direction, and a fragile part (a fragile part 78 to be described later for example) is formed in the cylindrical body at a position upstream of a smallest diameter part (a smallest diameter part 55 to be described later, for example), at which the inner diameter of the narrowing down part is the smallest, in the flow direction.

(2) An evaporative fuel processing device (an evaporative fuel processing device 2 or 2A to be described later, for example) of the present invention is characterized by including: a purge pump (a purge pump 5 or 5A to be described later, for example) which is a cylindrical body (a main body 51 or 51A to be described later, for example) having a discharge part (a discharge pipe 81 or a discharge part 967 to be described later, for example) that communicates with an intake passage (the intake pipe 4 to be described later, for example) of an internal combustion engine at a position upstream of a supercharger (the supercharger 93 to be described later, for example), a first inlet part (the first inlet pipe 52 to be described later, for example), and a second inlet part (the second inlet pipe 79 to be described later, for example), and designed to discharge a fluid, introduced through the first and second inlet parts, into the intake passage through the discharge part; a bypass passage (the bypass pipe 35 to be described later, for example) through which a part of the intake passage downstream of the supercharger and the first inlet part communicate with each other; and a purge passage (the first purge pipe 33 and the second purge pipe 36 to be described later, for example) through which a canister (the canister 32 to be described later, for example) that has an absorbing agent designed to absorb evaporative fuel and the second inlet part communicate with each other, the evaporative fuel processing device being characterized in that a pump flow passage (the pump flow passage 52 to be described later, for example) which extends in a flow direction where a fluid introduced through the first inlet part flows and through which a fluid introduced through the first inlet part and a fluid introduced through the second inlet part flow is disposed inside the cylindrical body, a narrowing gown part (the venturi 53 to be described later, for example) which decreases in diameter toward downstream is formed in the pump flow passage at a position downstream of the first inlet part in the flow direction, the cylindrical body constituted by combining: an upstream part (an upstream-side member 6 or 6A to be described later, for example) which constitutes the upstream side in the flow direction and in which the first inlet part is disposed; and a downstream part (a downstream-side member 8 or a coupling part 96A to be described later, for example) which constitutes the downstream side in the flow direction and in which the discharge part is disposed, and a connection part at which the upstream part and the downstream part are connected to each other is disposed upstream of a smallest diameter part (the smallest diameter part 55 to be described later, for example), at which the inner diameter of the narrowing down part the smallest, in the flow direction.

(3) In this case, it is preferable that the first inlet part is a nozzle whose proximal end part (a proximal end part 63 to be described later, for example) is connected to the bypass passage and whose distal end part (a distal end part 64 to be described later, for example) faces the inside of the pump flow passage, the cylindrical body includes a tubular part (a central tubular part 72 to be described later, for example) which is coaxial with an axis line (an axis line O to be described later, for example) of the first inlet part and covers an outer circumferential face of the distal end part, a gap part (a gap part 77 to be described later, for example) is provided between the outer circumferential face and an inner wall face (an inner wall face 72*a* to be described later, for example) of the tubular part, the purge passage communicates with the gap part through the second inlet part, and the smallest diameter part is formed downstream of the distal end part of the first inlet part in the flow direction.

(4) In this case, it is preferable that the downstream part is formed integrally with an intake pipe (the intake pipe 4 to be described later, for example) in which the intake passage is formed.

(5) In this case, it is preferable that the first inlet part is a nozzle whose proximal end part (the proximal end part 63 to be described later, for example) is connected to the bypass passage and whose distal end part (the distal end part 64 to be described later, for example) faces the inside of the pump flow passage, the cylindrical body includes a tubular part (the central tubular part 72 to be described later, for example) which is coaxial with an axis line (the axis line O to be described later, for example) of the first inlet part and covers an outer circumferential face of the distal end part, a gap part (the gap part 77 to be described later, for example) is provided between the outer circumferential face and an inner wall face (the inner wall face 72*a* to be described later, for example) of the tubular part, the purge passage communicates with the gap part through the second inlet part, and the smallest diameter part, is formed downstream of the distal end part of the first inlet part in the flow direction.

(6) In this case, it is preferable that the evaporative fuel processing device includes: a purge control valve (a purge control valve 34 to be described later, for example) which is disposed in the purge passage and configured to make the canister and the second inlet part communicate with or disconnect from each other; a pressure sensor (a pressure sensor 37 to be described later, for example) which is configured to detect pressure in the purge passage or in the canister; and an anomaly judgment unit (an ECU 38 to be described later, for example) which is configured to judge whether there is an anomaly in the purge pump based on a detection signal from the pressure sensor.

(7) In this case, it is preferable that the fragile part is formed in the cylindrical body at substantially the same position as a distal end face (a distal end face 64*a* to be described later, for example) of the first inlet part along the axis line.

(8) In this case, it is preferable that the connection part is disposed at substantially the same position as a distal end face (the distal end face 64*a* to be described later, for example) of the first inlet part along the axis line.

(9) A fluid processing device (the purge pump 5B to be described later, for example) of the present invention which is a cylindrical body (the main body 51B to be described later, for example) having a discharge part (the discharge pipe 81B to be described later, for example), a first inlet part (the first inlet pipe 62 to be described later, for example), and a second inlet part (the second inlet pipe 79 to be described later, for example), and designed to discharge a fluid, introduced through the first and second inlet parts, through the discharge part, the fluid processing device being characterized in that a pump flow passage (the pump flow passage 52 to be described later, for example) which extends in a flow direction where a fluid introduced through the first inlet part flows and through which a fluid introduced through the first inlet part and a fluid introduced through the second inlet part flow is disposed inside the cylindrical body, the first inlet part and the discharge part are arranged in the cylindrical body at positions opposed to each other in the flow direction, a narrowing down part (the venturi 53 to be described later, for example) which decreases in diameter toward downstream is formed in the pump flow passage at a position downstream of the first inlet part in the flow direction, and a fragile part (the fragile part 78 to be described later, for example) is formed in the cylindrical body at a position upstream of a smallest diameter part (the smallest diameter part 55 to be described later, for example), at which the inner diameter of the narrowing down part is the smallest, in the flow direction.

(10) A fluid processing device (the purge pump 5 or 5A to be described later, for example) of the present invention which is a cylindrical body (the main body 51 or 51A to be described later, for example) having a discharge part (the discharge pipe 81 or the discharge part 967 to be described later, for example), a first inlet part (the first inlet pipe 62 to be described later, for example) and a second inlet part (the second inlet pipe 79 to be described later, for example), and designed to discharge a fluid, introduced through the first and second inlet parts, through the discharge part, the fluid processing device being characterized in that a pump flow passage (the pump flow passage 52 to be described later, for example) which extends in a flow direction where a fluid introduced through the first inlet part flows and through which a fluid introduced through the first inlet part and a fluid introduced through the second inlet part flow is disposed inside the cylindrical body, the first inlet part and the discharge part are arranged in the cylindrical body at positions opposed to each other in the flow direction, a narrowing down part (the venturi 53 to be described later, for example) which decreases in diameter toward downstream is formed in the pump flow passage at a position downstream of the first inlet part in the flow direction, the cylindrical body is constituted by combining: an upstream part (the upstream-side member 6 or 6A to be described later, for example) which constitutes the upstream side in the flow direction and in which the first inlet part is disposed; and a downstream part (the downstream-side member 8 or the coupling part 96A to be described later, for example) which constitutes the downstream side in the flow direction and in which the discharge part is disposed, and a connection part (connection faces 74, 87, 74A, and 965 to be described later, for example) at which the upstream part and the downstream part are connected to each other is disposed upstream of a smallest diameter part (the smallest diameter part 55 to be described later, for example), at which the inner diameter of the narrowing down part is the smallest, in the flow direction.

Effects of Embodiments of the Invention (1) In the evaporative fuel processing device of the present invention, the discharge part of the purge pump which is the cylindrical body communicates with the intake passage at a position upstream of the supercharger, the first inlet part of the purge pump and a part of the intake passage downstream of the supercharger are connected to each other with the bypass passage, and the second inlet part of the purge pump and the canister which is designed to absorb evaporative fuel are connected to each other with the purge passage. In addition, the pump flow passage which extends in the flow direction where a fluid introduced through the first inlet part flows and through which a fluid introduced through the first and second inlet parts flow is disposed inside the cylindrical body where the discharge part and the first and second inlet parts are arranged, and the narrowing down part which decreases in diameter toward downstream in the flow direction is formed in this pump flow passage. During supercharging, a part downstream of the supercharger becomes a higher pressure than a part upstream of the supercharger. For this reason, a fluid in the part downstream of the supercharger partially flows into the pump flow passage through the bypass passage and the first inlet part, passes through the narrowing down part, and is then discharged into the intake passage through the discharge part. Here, since the sectional area of its flow passage is narrowed down in the narrowing down part, the fluid introduced through the first inlet part decreases in pressure and negative pressure is generated there by the Venturi effect. Hence, during supercharging, the flow of fluid from the canister to the second inlet part is generated and, with this flow, evaporative fuel absorbed by the absorbing agent is detached therefrom and discharged into the intake passage through the discharge part together with the fluid introduced through the first inlet part.

In addition, in the evaporative fuel processing device of the present invention, the fragile part is formed in the cylindrical body at a position upstream of the smallest diameter part, at which the inner diameter of the narrowing down part is the smallest, in the flow direction. Accordingly, when some sort of impact is applied on the purge pump, this fragile part of the purge pump is preferentially broken. In particular, in the evaporative fuel processing device of the present invention, by forming the fragile part at a position upstream of the smallest diameter part in the flow direction, if the fragile part is broken, a fluid introduced through the first inlet part flows out to the outside air through the broken part before the sectional area of its flow passage is narrowed down enough by the narrowing down part, so that negative pressure is not generated enough in the pump flow passage. For this reason, the flow of fluid from the canister to the second inlet part does not occur when the purge pump is broken, whereby it is possible to inhibit evaporative fuel absorbed by the absorbing agent from flowing out to the outside air through the broken part.

(2) According to the evaporative fuel processing device of the present invention, when the purge pump is normal, the device operates in the same manner as that in the invention (1) described above and can make evaporative fuel absorbed by the absorbing agent in the canister detached therefrom and discharged into the intake passage through the discharge part together with a fluid introduced through the first inlet pipe. In addition, in the evaporative fuel processing device of the present invention, the cylindrical body is constituted by combining the upstream part in which the first inlet part is disposed and the downstream part in which the discharge part is disposed. Further, in the evaporative fuel processing device of the present invention, the connection part at which the upstream part and the downstream part are connected to each other is disposed upstream of the smallest diameter part, at which the inner diameter of the narrowing down part is the smallest, in the flow direction. Hence, if the upstream part and the downstream part are disconnected from each other due to some reason, a fluid introduced through the first inlet part flows out to the outside air through the connection part before the sectional area of its flow passage is narrowed down enough by the narrowing down part, so that negative pressure is not generated enough in the pump flow passage. For this reason, the flow of fluid from the canister to the second inlet part does not occur when the upstream part and the downstream part are disconnected from each other, whereby it is possible to inhibit evaporative fuel absorbed by the absorbing agent from flowing out to the outside air through the connection part.

(3) In the evaporative fuel processing device of the present invention, by introducing a fluid, located in a part downstream of the supercharger, into the pump flow passage through the first inlet part which is a tubular nozzle, the flow rate of a fluid flowing through the narrowing down part can be increased. This makes it possible to generate larger negative pressure in the pump flow passage, and thereby allow the purge pump to draw more evaporative fuel and discharge it into the intake passage.

(4) For example, if the downstream part is made of a member separate from the intake pipe, a member for connecting the downstream part and the intake pipe to each other, a sealing member for filling the gap between the downstream part and the intake pipe, and the like need to be arranged. On the other hand, in the evaporative fuel processing device of the present invention, by forming the downstream part integrally with the intake pipe, it is possible to reduce the number of components.

(5) According to the evaporative fuel processing device of the present invention, the device operates in the same manner as that in the invention (3) described above and allows the purge pump to draw more evaporative fuel and discharge it into the intake passage.

(6) According to the evaporative fuel processing device of the present invention, the purge control valve is disposed in the purge passage, and the pressure sensor is disposed in the purge passage or the canister. Here, when the purge pump is normal and the pump flow passage does not communicate with the outside air, pulsation occurs in the purge passage or the canister with the opening and closing of the purge control valve. On the other hand, when some anomaly occurs in the purge pump and the pump flow passage communicates with the outside air, no pulsation occurs with the opening and closing of the purge control valve. According to the evaporative fuel processing device of the present invention, by judging whether there is pulsation as described above based on a detection signal from the pressure sensor, it is possible to judge whether or not an anomaly occurs in the purge pump even when the internal combustion engine is in an idling stop mode.

(7) In the evaporative fuel processing device of the present invention, the fragile part is formed in the cylindrical body at substantially the same position as the distal end face of the first inlet part along the axis line. Thereby, it is possible to enhance the manufacturability of the purge pump.

(8) In the evaporative fuel processing device of the present invention, the connection part is disposed at substantially the same position as the distal end face of the first inlet part along the axis line. Thereby, it is possible to enhance the manufacturability of the purge pump.

(9) In the fluid processing device of the present invention, the pump flow passage which extends in the flow direction where a fluid introduced through the first inlet part flows and through which a fluid introduced through the first and second inlet parts flow is disposed inside the cylindrical body, and the first inlet part and the discharge part are arranged in the cylindrical body at positions opposed to each other in the flow direction. In addition, the narrowing down part which decreases in diameter toward downstream in the flow direction is formed in this pump flow passage. According to this fluid processing device, when a fluid is introduced into the first inlet part, this fluid passes through the narrowing down part and is discharged through the discharge part. Here, since the sectional area of its flow passage is narrowed down in the narrowing down part, the fluid introduced through the first inlet part decreases in pressure and negative pressure is generated there by the Venturi effect. Hence, when a fluid is introduced through the first inlet part, it is possible to draw a fluid, located in a part to which the second inlet part is connected, into the pump flow passage and discharge it through the discharge part together with the fluid introduced through the first inlet part.

In addition, in the fluid processing device of the present invention, the fragile part is formed in the cylindrical body at a position upstream of the smallest diameter part, at which the inner diameter of the narrowing down part is the smallest, in the flow direction. Accordingly, when some sort of impact is applied on the fluid processing device, the fragile part of the fluid processing device is preferentially broken. In particular, in the fluid processing device of the present invention, by forming the fragile part at a position upstream of the smallest diameter part in the flow direction, if the fragile part is broken, a fluid introduced through the first inlet, part flows out to the outside air through the broken part before the sectional area of its flow passage is narrowed down enough by the narrowing down part, so that negative pressure is not generated enough in the pump flow passage. For this reason, no fluid is drawn into the pump flow passage through the second inlet part when the purge pump is broken, whereby it is possible to inhibit a fluid, located in a part to which the second inlet part is connected, from flowing out to the outside air through the broken part.

(10) According to the fluid processing device of the present invention, when the fluid processing device is normal, the device operates in the same manner as that in the invention (8) described above and can draw a fluid, located in a part to which the second inlet part is connected, into the pump flow passage and discharge it through the discharge part together with the fluid introduced through the first inlet part. In addition, in the fluid processing device of the present invention, the cylindrical body is constituted by combining the upstream part in which the first inlet part is disposed and the downstream part in which the discharge part is disposed. Further, in the fluid processing device of the present invention, the connection part at which the upstream part and the downstream part are connected to each other is disposed upstream of the smallest diameter part, at which the inner diameter of the narrowing down part is the smallest, in the flow direction. Hence, if the upstream part and the downstream part are disconnected from each other due to some reason, a fluid introduced through the first inlet part flows out to the outside air through the connection part before the sectional area of its flow passage is narrowed down enough by the narrowing down part, so that negative pressure is not generated enough in the pump flow passage. For this reason, no fluid is drawn into the pump flow passage through the second inlet part when the upstream part and the downstream part are disconnected from each other, whereby it is possible to inhibit a fluid, located in a part to which the second inlet part is connected, from flowing out to the outside air through the broken part.

DETAILED DESCRIPTION OF EMBODIMENTS OF THE INVENTION

First Embodiment

Hereinbelow, a first embodiment of the present invention is described with reference to the drawings.

Figure 1:
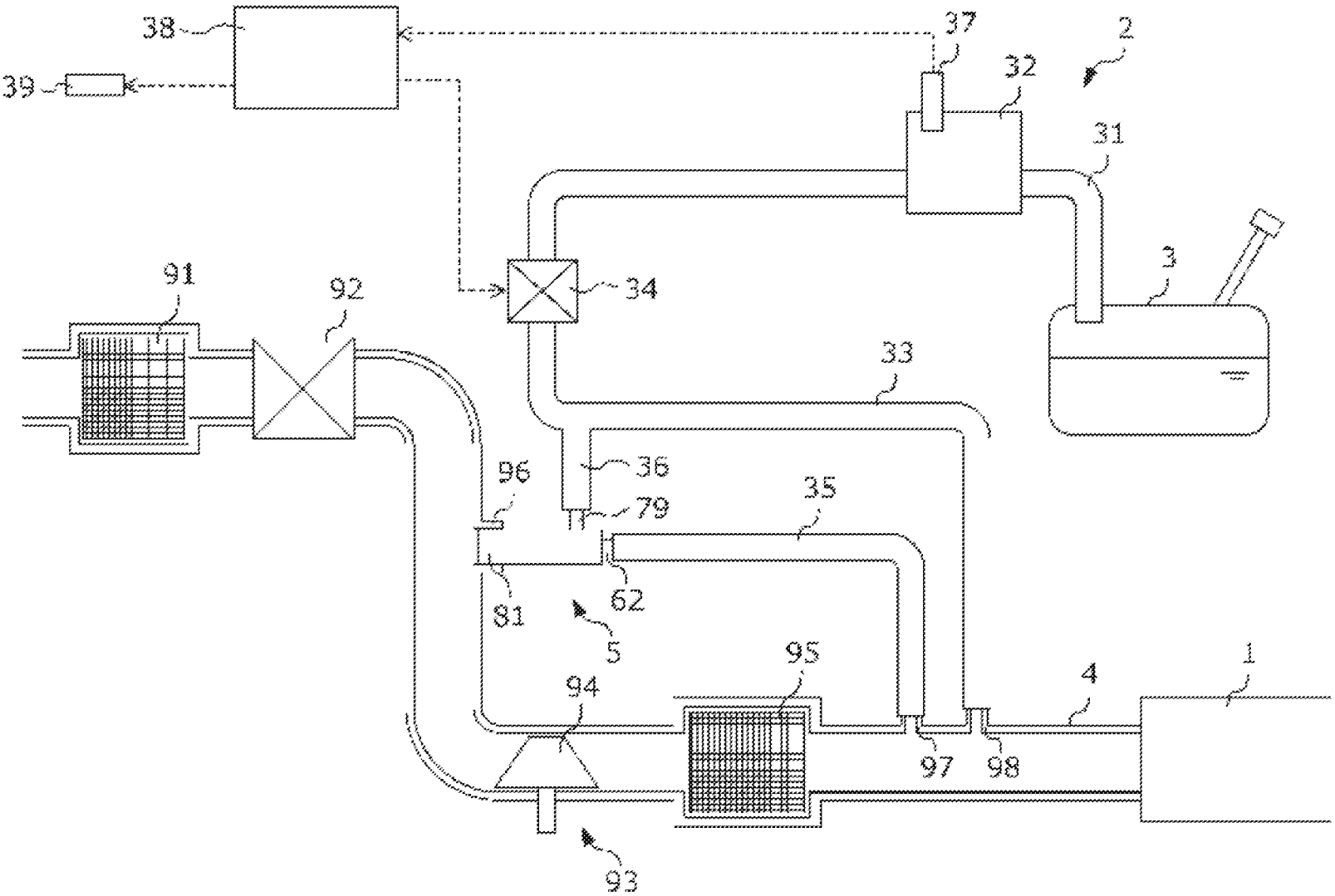
FIG. 1 is a diagram schematically illustrating the configuration of an evaporative fuel processing device according to a first embodiment of the present invention and that of an intake system of an engine that employs this evaporative fuel processing device.

FIG. 1 is a diagram schematically illustrating the configuration of an evaporative fuel processing device 2 according to this embodiment and that of an intake system of an internal combustion engine (hereinafter simply referred to as an "engine") 1 that employs this evaporative fuel processing device 2.

An intake pipe 4 designed to feed the air into each cylinder (not illustrated) of the engine 1 is provided with, from the upstream side to the downstream side: an air cleaner 91 which is configured to remove foreign substances in the air; an airflow meter 92 which is configured to generate a signal according to the flow rate of the air to be introduced into each cylinder through the intake pipe 4; a compressor 94 of a supercharger 93 which is configured to compress intake air using exhaust energy of the engine 1; and an intercooler 95 which is configured to cool intake air.

The intake pipe 4 is provided with a coupling part 96, to which a purge pump 5 to be described later is coupled, at a position upstream of the compressor 94 and downstream of the airflow meter 92. The intake pipe 4 is provided with a returning part 97, to which a bypass pipe 35 to be described later is coupled, at a position downstream of the compressor 94 and the intercooler 95. In addition, the intake pipe 4 is provided with an inlet part 98, to which a first purge pipe 33 to be described later is coupled, at a position downstream of the returning part 97. The coupling part 96, the returning part 97, and the inlet part 58 are each tubular in form. The coupling part 96, the returning part 97, and the inlet part 98 are formed integrally with the intake pipe 4 by joining them to the intake pipe 4 by welding, for example.

The evaporative fuel processing device 2 includes: a fuel tank 3 which stores therein fuel of the engine 1; a canister 32 which is connected to the fuel tank 3 via a charge pump 31; the first purge pipe 33 which connects the canister 32 and the inlet part 98 to each other; a purge control valve 34 which is provided in the first purge pipe 33; the purge pump 5 which is designed to discharge a fluid, introduced through a first inlet pipe 62 and a second inlet pipe 79, through a discharge pipe 81; the bypass pipe 35 which connects the first inlet pipe 62 of the purge pump 5 and the returning part 97 to each other; a second purge pipe 36 which branches from the first purge pipe 33 and extends to the second inlet pipe 79 of the purge pump 5; and an electronic control unit 38 (hereinafter referred to as an "ECU 38").

The canister 32 includes an absorbing agent (such as an activated carbon, concretely) (not illustrated) which is designed to absorb evaporative fuel. Evaporative fuel generated in the fuel tank 3 is introduced into the canister 32 via the charge pipe 31 and stored temporarily in the absorbing agent of the canister. The canister 32 is provided with a pressure sensor 37. The pressure sensor 37 is configured to send the ECU 38 a detection signal according to the pressure inside the canister 32.

The canister 32 is connected to the inlet part 98 via the first purge pipe 33. The first purge pipe 33 is provided with the purge control valve 34. Once this purge control valve 34 opens, the canister 32 communicates with the intake pipe 4; once the purge control valve 34 closes, the canister 32 and the intake pipe 4 disconnect from each other. In a non-supercharging area where the compressor 94 of the supercharger 93 stops its rotation, negative pressure is generated inside the intake pipe 4, and thus the pressure therein decreases below atmospheric pressure. In the non-supercharging area, this negative pressure makes the air flow from the canister 32 to the intake pipe 4, and the evaporative fuel absorbed by the absorbing agent in the canister 32 flows into the intake pipe 4 along with this flow and is used for combustion in the engine 1.

The second purge pipe 36 branches from the first purge pipe 33 at a position closer to the inlet part 98 than the purge control valve 34, and extends to the second inlet pipe 79 of the purge pump 5. Once the purge control valve 34 opens, the canister 32 communicates with the second inlet, pipe 79; once the purge control valve 34 closes, the canister 32 and the second inlet pipe 79 disconnect from each other.

The bypass pipe 35 connects the returning part 97 of the intake pipe 4 and the first inlet pipe 62 of the purge pump 5 to each other. In addition, the discharge pipe 81 of the purge pump 5 is coupled to the coupling part 96 of the intake pipe 4. In a supercharging area where the compressor 94 of the supercharger 93 is driven to rotate, positive pressure is generated in the intake pipe 4 in an area downstream of the compressor 94, and thus the pressure therein increases above atmospheric pressure. Thereby, in the supercharging area, this positive pressure makes the air flow from the returning part 97 to the first inlet pipe 62.

As will be described in detail later with reference to FIGS. 2 to 7, the purge pump 5 is in the form of a tube extending from the first inlet pipe 62 to the discharge pipe 81, and a venturi is provided in a pump flow passage formed inside the purge pump. Thereby, when the air is introduced from the returning part 97 to the first inlet pipe 62 in the supercharging area, negative pressure is generated during the process in which the air from the first inlet pipe 62 flows to the discharge pipe 81. In the supercharging area, this negative pressure makes the air flow from the canister 32 to the second inlet pipe 79, and the evaporative fuel absorbed by the absorbing agent in the canister 32 is discharged into the intake pipe 4 through the discharge pipe 81 along with this flow.

As described above, in the evaporative fuel processing device 2, during non-supercharging, by negative pressure generated in the intake pipe 4, the evaporative fuel absorbed in the canister 32 is fed into the intake pipe 4 through the inlet part 98 by way of the first purge pipe 33. Meanwhile, during supercharging, by the purge pump 5 activated by positive pressure generated in the intake pipe 4 in an area downstream of the compressor 94, the evaporative fuel absorbed in the canister 32 is fed into the intake pipe 4 through the coupling part 96 by way of the second purge pipe 36 and the purge pump 5.

The ECU 8 is a microcomputer constituted of components such as: an I/O interface which is configured to convert a detection signal of a sensor from analog to digital; a RAM and a ROM which are configured to store various data and various programs; a CPU which is configured to execute the various programs; and a drive circuit which is configured to open and close the purge control valve 34 according to a mode determined under the processing of the CPU. Here, the programs to be executed in the ECU 8 include: a program for opening and closing the purge control valve 34 when purging the evaporative fuel, absorbed in the canister 32, in the above route; a program for detecting an anomaly of the purge pump using a detection signal of the pressure sensor 37; and the like.

Next, the configuration of the purge pump 5 is described with reference to FIGS. 2 to 7.

Figure 2:
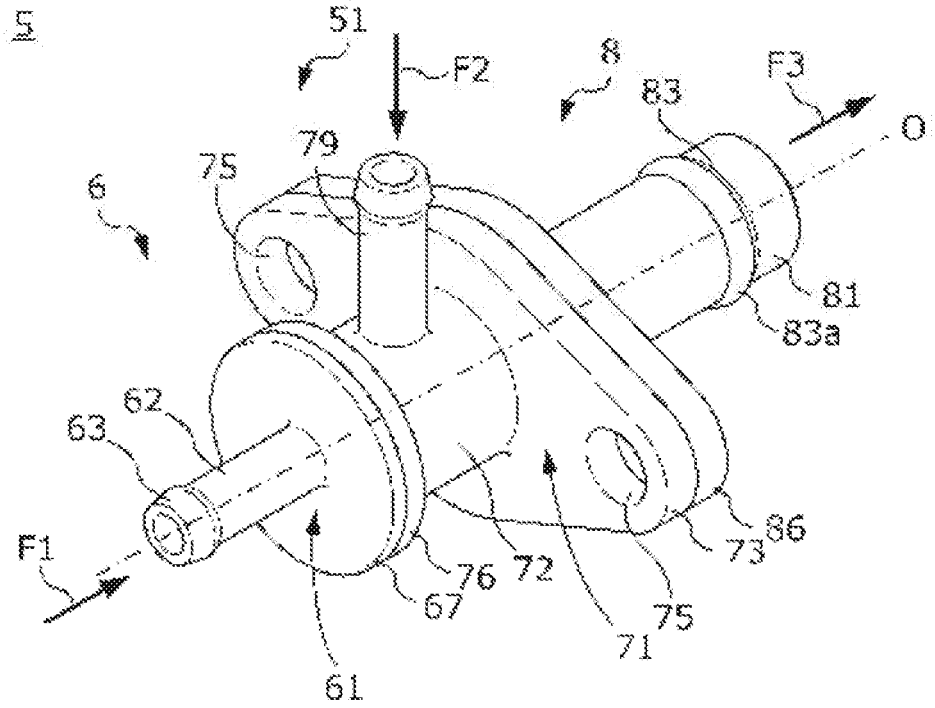
FIG. 2 is a perspective view of a purge pump.
Figure 3:
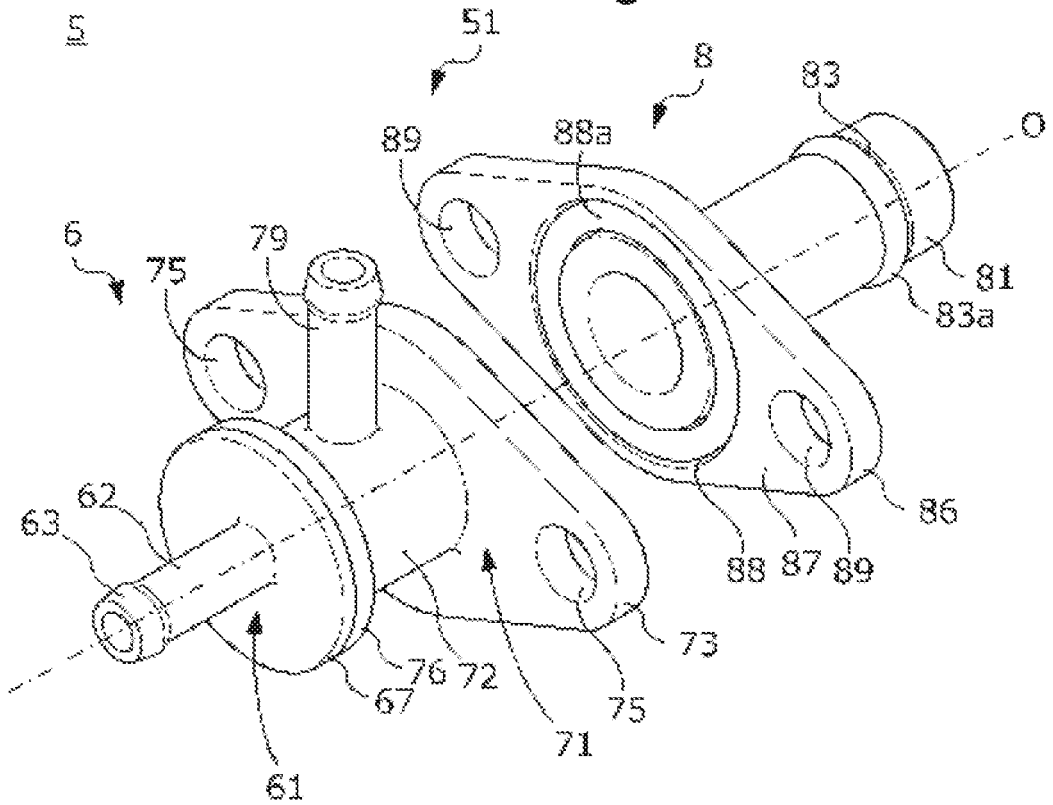
FIG. 3 is an exploded perspective view of the purge pump.
Figure 4:
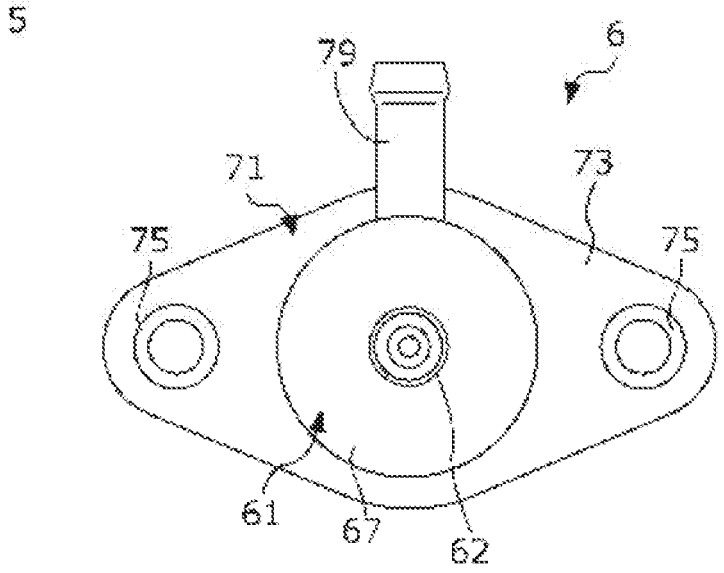
FIG. 4 is a front view of the purge pump.
Figure 5:
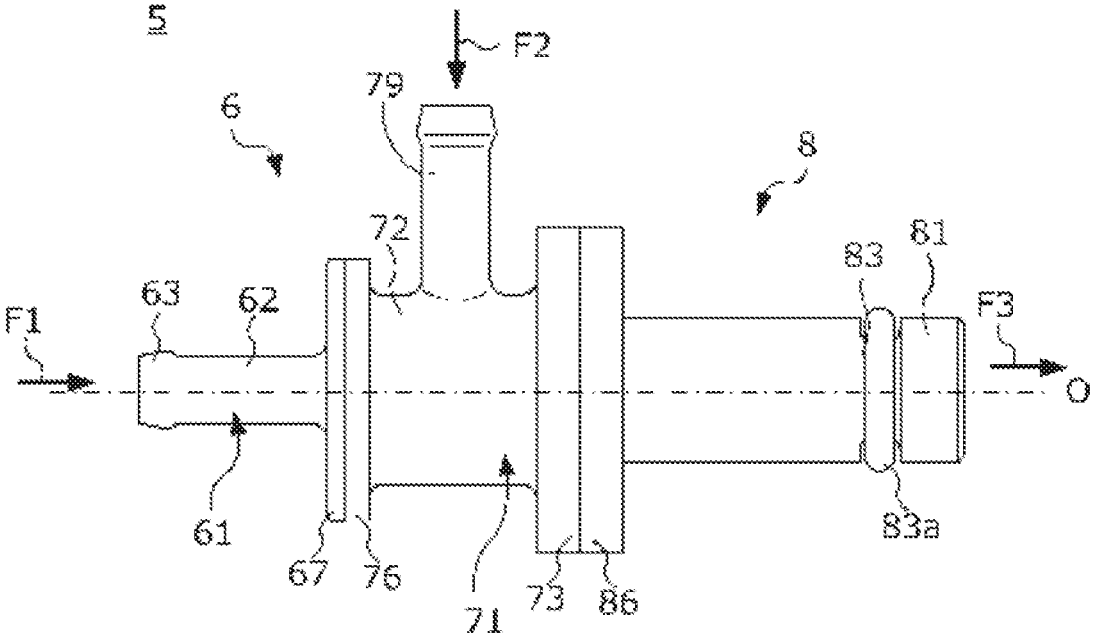
FIG. 5 is a side view of the purge pump.
Figure 6:
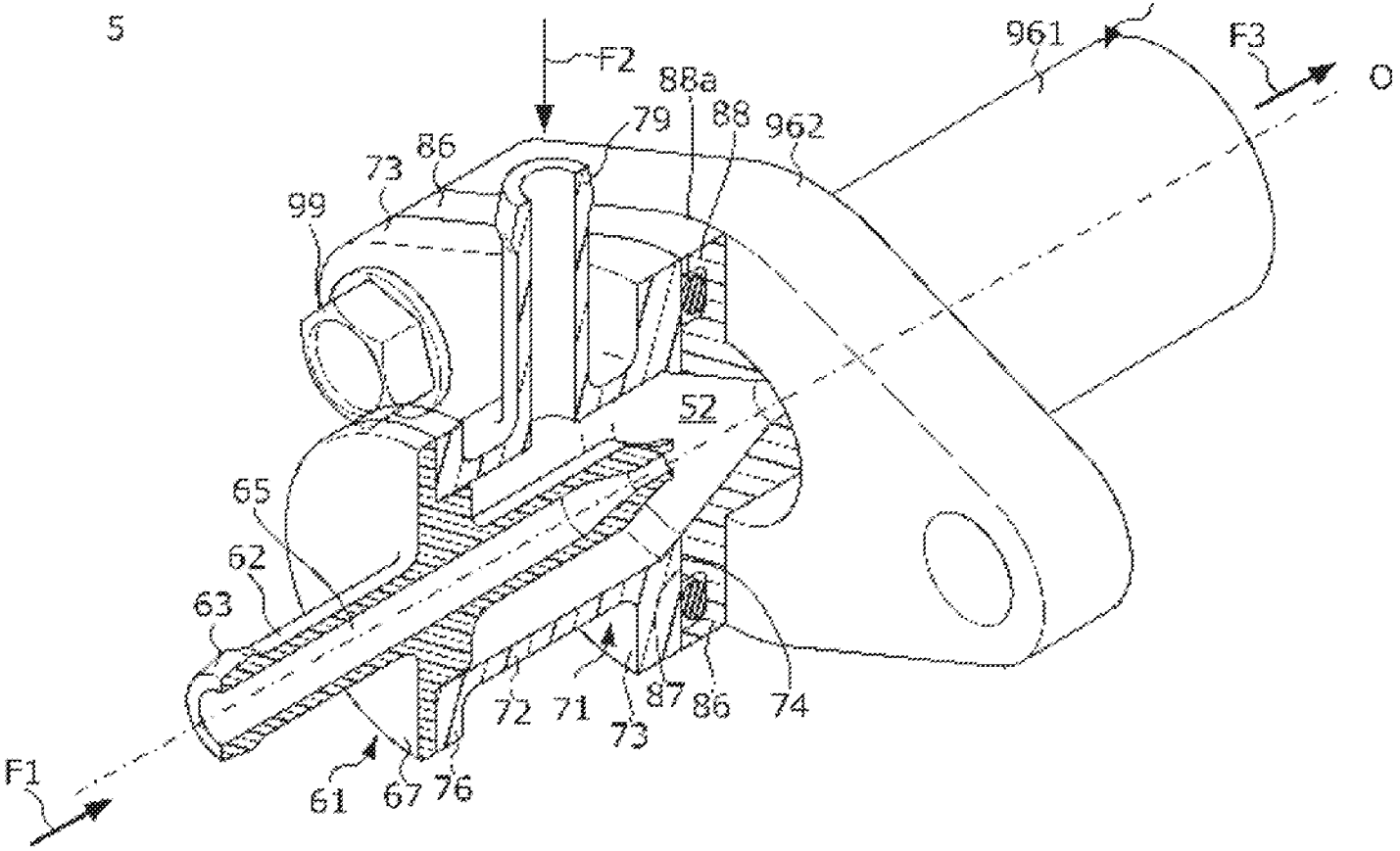
FIG. 6 is a perspective view in which the purge pump mounted on a coupling part of an intake pipe is partially broken out.
Figure 7:
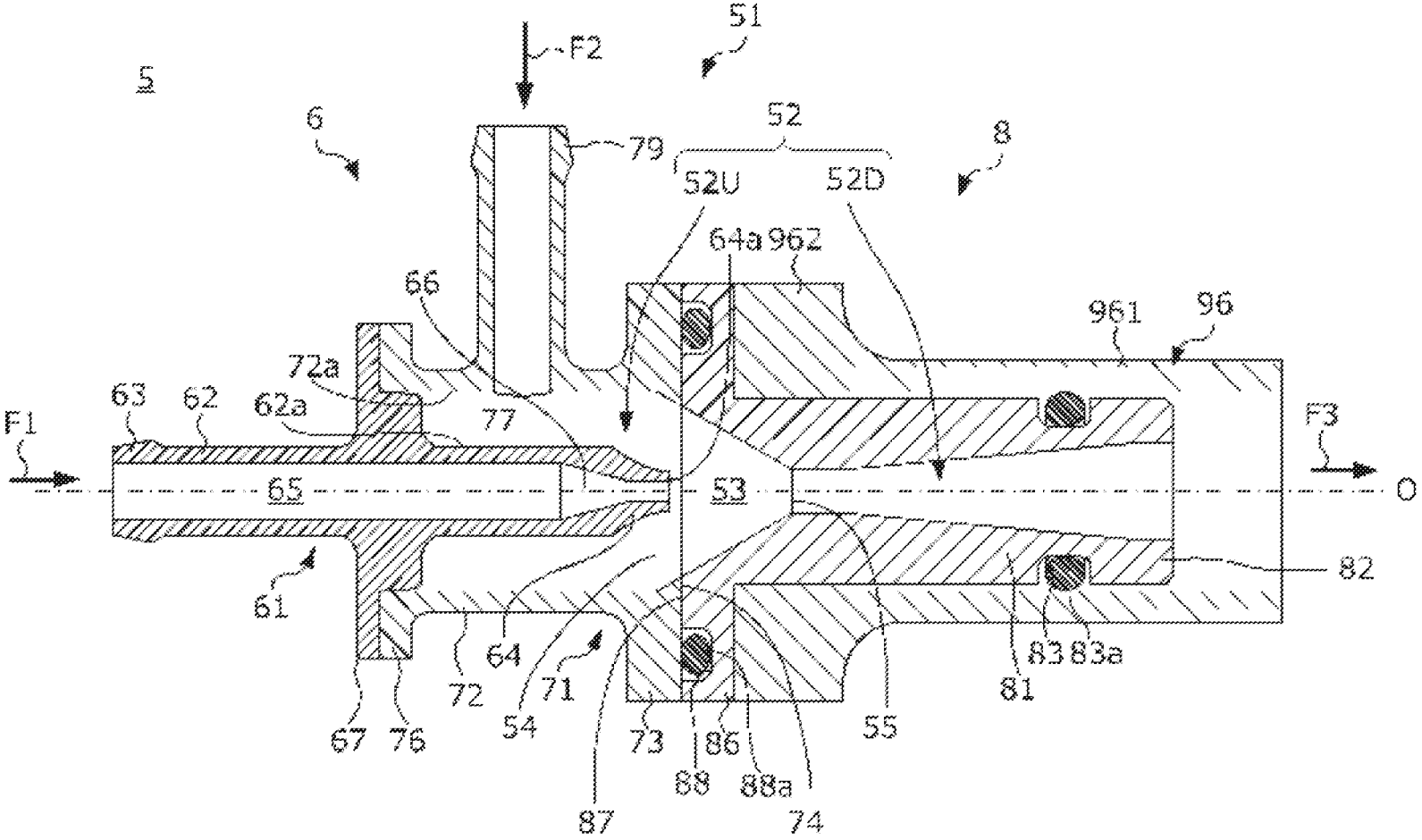
FIG. 7 is a sectional view of the coupling part and the purge pump.

FIG. 2 is a perspective view of the purge pump 5, and FIG. 3 is an exploded perspective view of the purge pump 5. FIG. 4 is a front view of the purge pump 5, and more specifically is a view in which the purge pump 5 is seen from the first inlet pipe 62 side in the discharge direction of the purge pump. FIG. 5 is a side view of the purge pump 5. FIG. 6 is a perspective view in which the purge pump 5 mounted on the coupling part 96 of the intake pipe 4 is partially broken out. In addition. FIG. 7 is a sectional view of the coupling part 96 and the purge pump 5.

A main body 51 of the purge pump 5 is in the form of a cylinder extending along an axis line O, and a pump flow passage 52 extending along the axis line O is formed inside the main body. The main body 51 includes: the first inlet pipe 62 which is designed to lead the air, fed from the returning part 97 in a flow direction F1 coaxial with the axis line O, into the pump flow passage 52; the second inlet pipe 79 which is designed to lead the air, fed from the canister 32 in a flow direction F2 perpendicular to the axis line O and containing evaporative fuel, into the pump flow passage 52; and the discharge pipe 81 which is disposed opposite the first inlet pipe 62 along the axis line O and designed to discharge the air, led into the pump flow passage 52 through the two inlet pipes 62, 79, in a flow direction F3 coaxial with the axis line O.

In addition, as illustrated in FIG. 3, the main body 51 is constituted by combining: an upstream-side member 6 which extends in the flow direction F1 and constitutes the upstream side; and a downstream-side member 8 which extends in the flow direction F1 and constitutes the downstream side, for example. The first inlet pipe 62 and the second inlet pipe 79 described above are disposed in the upstream-side member 6, and the discharge pipe 81 described above is disposed in the downstream-side member 8.

The downstream-side member 8 is made of resin, for example, and includes: the discharge pipe 81 in which a downstream flow passage 52D being the downstream side of the pump flow passage 52 is formed; and a downstream-side flange part 86 which is disposed on an upstream end part of the discharge pipe 81 in the flow direction F3. The discharge pipe 81 is in the form of a cylinder extending along the axis line O. A groove part 83 is formed across the entire circumference in an outer circumferential face of the discharge pipe 81 in an area slightly close to its distal end part 82. In addition, a circular and elastic sealing member 83*a* is fitted in this groove part 83.

The downstream-side flange part 86 is a brim-shaped part extending perpendicular to the direction the discharge pipe 81 extends, that is, the axis line O. An annular groove part 88 is formed in a connection face 87 of the downstream-side flange part 86, which is the upstream-side member 6 side face, so as to surround the downstream flow passage 52D. In addition, a circular and elastic sealing member 88*a* is fitted in this groove part 88. Besides, two bolt holes 89, 89 in which bolts 99 to be described later are inserted are formed in the downstream-side flange part 86 in an area radially outward of the groove part 88.

The upstream-side member 6 is made of resin, for example, and constituted by combining: a first member 61 in which the first inlet pipe 62 described above is formed; and a second member 71 in which the second inlet pipe 79 described above is formed.

The first member 61 includes: the first inlet pipe 62 which is in the form of a tube extending along the axis line O; and a brim part 67 which is disposed at substantially the center of the first inlet pipe 62 along the axis line O. The first inlet pipe 62 is a nozzle whose proximal end part 63 is connected to the bypass pipe 35 and whose distal end part 64 faces the inside of the pump flow passage 52. A nozzle flow passage 65 extending along the axis line O is formed inside the first inlet pipe 62. In addition, a venturi 66 which decreases in diameter toward downstream in the flow direction F3 is formed on the distal end part 64 side of this nozzle flow passage 65. Thereby, the air introduced through the first inlet pipe 62 accelerates while passing through this venturi 66, and is ejected into the pump flow passage 52 through the distal end part 64 along the axis line O. Besides, as illustrated in FIG. 4, the brim part 67 is disc-shaped in the front view.

The second member 71 includes: a central tubular part 72 which is in the form of a tube extending along the axis line O; and the second inlet pipe 79 which is disposed at substantially the center of this central tubular part 72 along the axis line O. An upstream flow passage 52U being the upstream side of the pump flow passage 52 is formed inside the central tubular part 72. An upstream-side flange part 73 is disposed on the downstream-side member 8 side of the central tubular part 72. In addition, a brim part 76 is disposed on the first member 61 side of the central tubular part 72.

The upstream-side flange part 73 is a brim-shaped part extending perpendicular to the axis line O, and has substantially the same shape as the downstream-side flange part 86 as illustrated in FIG. 3. One face of the upstream-side flange part 73 on the downstream-side member 8 side thereof is a connection face 74 which is connected to the connection face 87 of the downstream-side flange part 86 when the upstream-side member 6 and the downstream-side member 8 are combined with each other. In addition, two bolt holes 75, 75 in which the bolts 99 to be described later are inserted are formed in the upstream-side flange part 73.

The brim part 76 is a brim-shaped part extending perpendicular to the axis line O, and has substantially the same shape as the brim part 67 of the first member 61 as illustrated in FIG. 3. The first member 61 and the second member 71 are bonded while their brim parts 67, 76 butt against each other by welding the opposed faces of the brim parts, for example.

The upstream flow passage 52U which is coaxial with the axis line O and covers an outer circumferential face of the distal end part 64 of the first inlet pipe 62 is formed inside central tubular part 72. In addition, the inner diameter of the upstream flow passage 52U is larger than the outer diameter of the first inlet pipe 62. In other words, a gap part 77 is provided between an inner wall face 72*a* of the central tubular part 72 and an outer circumferential face 62*a* of the first inlet pipe 62 which form the upstream flow passage 52U.

The second inlet pipe 79 extends perpendicular to the axis line O and penetrates an outer circumferential part of the central tubular part 72. As described previously, the second purge pipe 36 is connected to the second inlet pipe 79. The second purge pipe 36 communicates with the gap part 77 via the second inlet pipe 79.

Next, with reference to FIGS. 6 and 7 etc., a description is given of the procedure of uniting the upstream-side member 6 and the downstream-side member 8 to assemble the main body 51 and mounting the main body 51 on the coupling part 96 of the intake pipe 4. Here, the coupling part 96 includes: a tubular part 961 which branches and extends from the intake pipe 4; and a flange part 962 which is disposed on the distal end side of the tubular part 961 (see FIG. 6). The inner diameter of the tubular part 961 is slightly larger than the outer diameter of the discharge pipe 81 of the downstream-side member 8. In addition, the flange part 962 has substantially the same shape as the downstream-side flange part 86.

First, the downstream-side member 8 is mounted on the coupling part 96. More specifically, the sealing member 83*a* is first fitted into the groove part 83 of the downstream-side member 8. Next, the discharge pipe 81 of the down stream-side member 8 is pressed into the tubular part 961 along the axis line O until the downstream-side flange part 86 is brought into contact with the flange part 962 of the coupling part 96.

Subsequently, the upstream-side member 6 is mounted on the downstream-side member 8. More specifically, the sealing member 88*a* is first fitted into the groove part 88 of the downstream-side member 8. Next, the upstream-side flange part 73 of the upstream-side member 6 is brought closer to the downstream-side flange part 86 of the downstream-side member 8. In this event, the connection face 74 of the upstream-side flange part 73 is brought closer to the connection face 87 of the downstream-side flange part 86 so that the two bolt holes 75, 75 formed in the upstream-side flange part 73 and the two bolt holes 89, 89 formed in the downstream-side flange part 86 are aligned with each other. Next, in a state where the upstream-side flange part 73 and the downstream-side flange part 86 are close to each other, the two bolts 99 (only one of them is illustrated in FIG. 6) are inserted into the bolt holes 75, 75 and the bolt holes 89, 89. Subsequently, the two bolts 99 are fastened until the connection face 74 of the upstream-side flange part 73 and the connection face 87 of the downstream-side flange part 86 are brought into close contact with each other.

Thereby, the upstream-side member 6 and the downstream-side member 8 are united with each other and the main body 51 is assembled, and this main body 51 is mounted on the coupling part 96. In addition, the opening of the upstream flow passage 52U, which is formed in the upstream-side member 6, on the connection face 74 side thereof and the opening of the downstream flow passage 52D, which is formed in the downstream-side member 8, on the connection face 87 side thereof have the same shape. Accordingly, by assembling the main body 51 as described above, the inner wall face of the upstream flow passage 52U and the inner wall face of the downstream flow passage 52D become flush with each Other to form one pump flow passage 52 that is coaxial with the axis line O.

Next, with reference to FIG. 7, a description is given of the specific configuration of the pump flow passage 52 formed inside the main body 51.

A venturi 53 which is a narrowing down part that decreases in diameter toward downstream in the flow direction F1 is formed in the pump flow passage 52 at a position downstream of the first inlet pipe 62 in the flow direction F1. The venturi 53 is formed along the axis line O over a predetermined length extending from a largest diameter part 54 which is the largest in inner diameter to a smallest diameter part 55 which is the smallest in inner diameter. In addition, as illustrated in FIG. 7, the smallest diameter part 55 is disposed downstream of a distal end face 64*a* of the first inlet pipe 62 in the flow direction F1 while the largest diameter part 54 is disposed upstream of the distal end face 64*a* of the first inlet pipe 62 in the flow direction F1. Further, the distal end face 64*a* of the first inlet pipe 62 is disposed at substantially the same position as the connection faces 74, 87 of the upstream-side member 6 and the downstream-side member 8 along the axis line O.

The purge pump 5 including the venturi 53 as described above operates during supercharging in the following manner. During supercharging, as described with reference to FIG. 1, since differential pressure is generated before and after the compressor 94, the air flowing through the intake pipe 4 partially flows into the first inlet pipe 62 through the returning part 97. The air introduced through the first inlet pipe 62 flows through the nozzle flow passage 65 in the flow direction F1, accelerates at the venturi 66, and then flows into the pump flow passage 52 from the distal end face 64*a*. The air ejected from the distal end face 64*a* accelerates while flowing through the venturi 53 where the sectional area of its flow passage is narrowed down, and is discharged into the intake pipe 4 through the discharge pipe 81 in the flow direction F3. Here, when the sectional area of the flow passage of the air introduced through the first inlet pipe 62 is decreased by the venturi 53, negative pressure is generated inside the pump flow passage 52 by the Venturi effect. This negative pressure generates the flow of the air from the canister 32 to the second inlet pipe 79, whereby the evaporative fuel absorbed by the absorbing agent in the canister 32 is introduced to the gap part 77 in the pump flow passage 52 in the flow direction F2 along with this flow of the air, and is then discharged through the discharge pipe 81 while being mixed with the flow of the air flowing from the distal end face 64*a* of the first inlet pipe 62.

Next, the position where the venturi 53 is provided is described in more detail. As described previously, the venturi 53 is provided in the pump flow passage 52, and this pump flow passage 52 is constituted by combining the upstream-side member 6 and the downstream-side member 8. If the bolt 99 for keeping the upstream-side member 6 and the downstream-side member 8 in one unit loosens or comes off due to some circumstances, a gap is generated between the connection face 74 of the upstream-side member 6 and the connection face 87 of the downstream-side member 8. The generation of such a gap makes the pump flow passage 52 communicate with the outside air through this gap, and therefore evaporative fuel fed from the canister 32 to the pump flow passage 52 through the second inlet pipe 79 might flow out through this gap. To cope with this, the venturi 53 of this embodiment is disposed at such a position that its Venturi effect disappears or decreases if such a failure occurs in the main body 51.

More specifically, the smallest diameter part 55 of the venturi 53 is disposed downstream of the connection faces 74, 87 of the upstream-side member 6 and the downstream-side member 8 in the flow direction F1. Thereby, if a failure occurs in the main body 51 and a gap is thus formed between the connection face 74 and the connection face 87, the air having flowed out from the distal end face 64*a* of the first inlet pipe 62 flows out to the outside air through the gap before the sectional area of its flow passage is narrowed down enough by the venturi 53, so that the Venturi effect hardly occurs or decreases. For this reason, even if the air flows out from the distal end face 64*a* of the first inlet pipe 62 during supercharging, the airflow from the canister 32 to the second inlet pipe 79 hardly occurs, whereby it is possible to inhibit evaporative fuel from flowing out through this gap.

Note that, FIG. 7 illustrates the case where the connection faces 74, 87 are arranged upstream of the smallest diameter part 55 in the flow direction F1 and downstream of the largest diameter part 54 in the flow direction F1, but the position where the connection faces 76, 87 are arranged is not limited to this. The connection faces 74, 87 may be arranged at any position as long as they are located upstream of the smallest diameter part 55 in the flow direction F1, and they may be located upstream of the largest diameter part 54 in the flow direction F1.

Returning to FIG. 1, a description is given of the procedure for the ECU 8 to judge whether there is an anomaly in the purge pump 5. When the purge pump 5 is normal and the pump flow passage 52 does not communicate with the outside air, pulsation occurs in the purge pipes 33, 36 and the canister 32 with the opening and closing of the purge control valve 34. On the other hand, when some anomaly occurs in the purge pump 5 and the pump flow passage 52 communicates with the outside air as described above, no pulsation occurs with the opening and closing of the purge control valve 34. Hence, the ECU 8 opens and closes the purge control valve 34 at a predetermined cycle and at given timings irrespective of the operating state of the engine 1, and judges, from a detection signal of the pressure sensor 37, whether there is pulsation which would occur if the purge pump 5 is normal. The ECU 8 judges that the purge pump 5 is normal if pulsation is detected from the detection signal of the pressure sensor 37. Meanwhile, if no pulsation can be detected from the detection signal of the pressure sensor 37, the ECU 8 judges that an anomaly occurs in the purge pump 5, and lights a warning lamp 39 to inform a driver of this fact.

Second Embodiment

Next, a second embodiment of the present invention is described with reference to the drawings. An evaporative fuel processing device according to this embodiment differs from the evaporative fuel processing device 2 according to the first embodiment in the configuration of a purge pump. Note that, in the following description, the same constituents as those of the first embodiment are given the same reference numerals and the description thereof is omitted.

Figure 8:
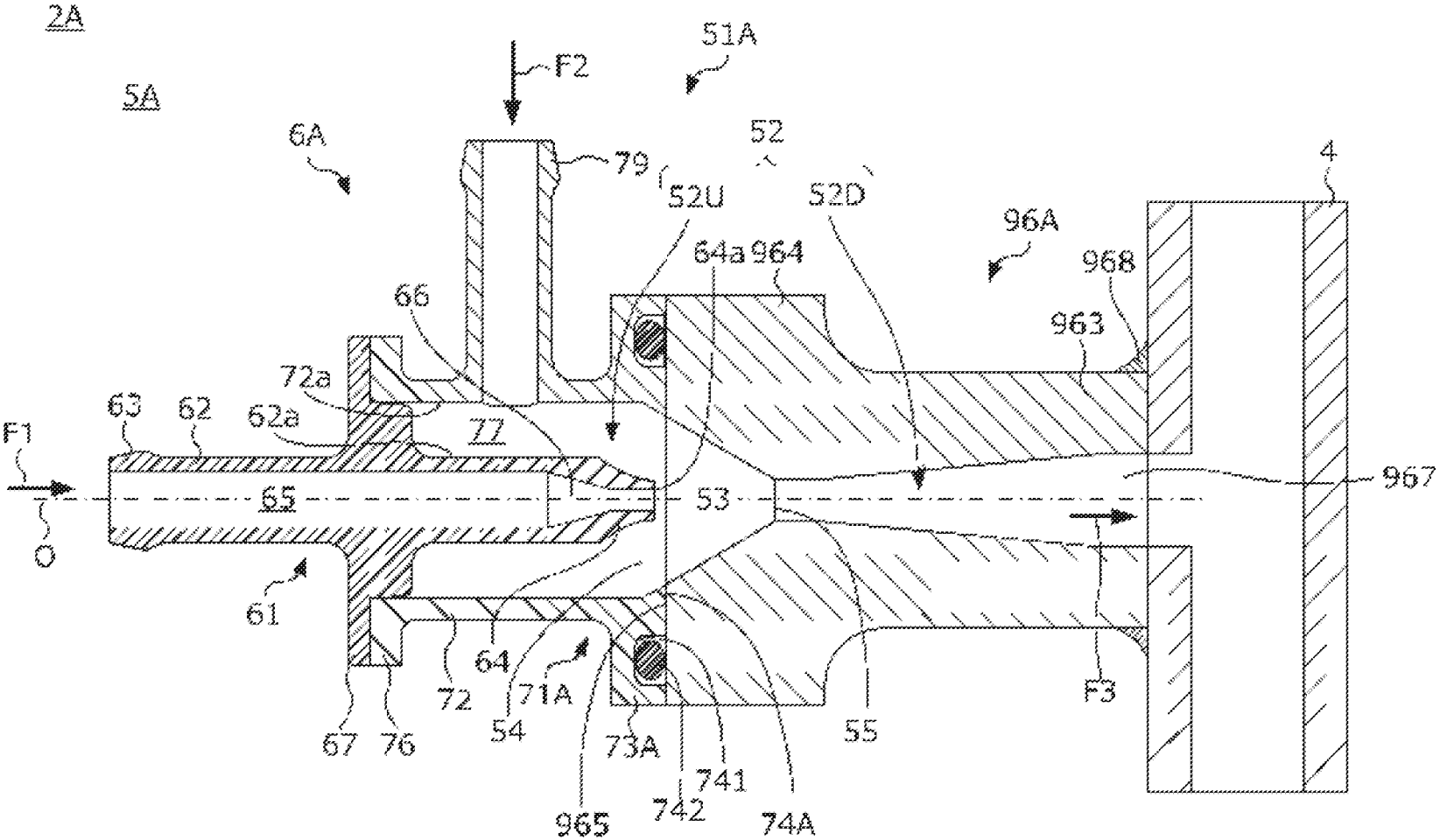
FIG. 8 is a sectional view of a purge pump used in an evaporative fuel processing device according to a second embodiment of the present invention.

FIG. 8 is a sectional view of a purge pump 5A used in an evaporative fuel processing device 2A according to this embodiment. The first embodiment illustrates the case where the coupling part 96 formed integrally with the intake pipe 4 and the purge pump 5 are separate members. On the other hand, the purge pump 5A according to this embodiment differs from the purge pump 5 according to the first embodiment in that it includes a coupling part 96A, formed integrally with the intake pipe 4, as its component and exerts its function when combined with this coupling part 96A.

A main body 51A of the purge pump 5A is constituted by combining: an upstream-side member 6A which constitutes the upstream side in the flow direction F1; and the coupling part 96A as a downstream member which constitutes the downstream side in the flow direction F1. In addition, inside the main body 51A, the pump flow passage 52 extending along the axis line O is formed to extend across the upstream-side member 6A and the coupling part 96A. Besides, as in the first embodiment, the upstream-side member 6A is provided with: the first inlet pipe 62 which is designed to lead the air, fed from the returning part 97 in the flow direction F1, into the pump flow passage 52; and the second inlet pipe 79 which is designed to lead the air, fed from the canister 32 in the flow direction F2 and containing evaporative fuel, into the pump flow passage 52.

The coupling part 96A is in the form of a tube extending along the axis line O. The coupling part 96A is formed integrally with the intake pipe 4 by joining its proximal end part 963 to the intake pipe 4 by welding 968, for example. Inside the coupling part 96A, the downstream flow passage 52D which is the downstream side of the pump flow passage 52 is formed. Besides, a part of this downstream flow passage 52D on the proximal end part 963 side thereof constitutes a discharge part 967 which is designed to discharge the air, led into the pump flow passage 52 through the two inlet pipes 62, 79, in the flow direction F3 coaxial with the axis line O to lead it toward an intake passage formed inside the intake pipe 4. In addition, a downstream-side flange part 964 in the form of a brim extending perpendicular to the axis line O is disposed in the coupling part 96A on the distal end side thereof. A face of the downstream-side flange part 964 on the upstream-side member 6A side thereof constitutes a connection face 965.

The upstream-side member 6A is constituted by combining: the first member 61 in which the first inlet pipe 62 is formed; and a second member 71A in which the second inlet pipe 79 is formed. The configuration of the first member 61 is the same as that in the first embodiment. The configuration of the second member 71A is the same as that of the second member 71 in the first embodiment except for the configuration of an upstream-side flange part 73A.

The upstream-side flange part 73A of the second member 71A has substantially the same shape as the down stream-side flange part 964 of the coupling part 96A. A face of the upstream-side flange part 73A on the coupling part 96A side thereof constitutes a connection face 74A to come into contact with the connection face 965 of the downstream-side flange part 964 of the coupling part 96A when the upstream-side member 6A and the coupling part 96A are combined with each other. In addition, an annular groove part 741 is formed in this connection face 74A so as to surround the upstream flow passage 52U. Besides, a circular and elastic sealing member 742 is fitted in this groove part 741.

The upstream-side member 6A described above is secured on the coupling part 96A by aligning the connection face 74A of the upstream-side flange part 73A with the connection face 965 of the down stream-side flange part 964 and then fastening these flange parts 73A, 964 with bolts (not illustrated) in this state. Thereby, the upstream-side member 6A and the coupling part 96A are combined with each other and the main body 51A is assembled. In addition, the opening of the upstream flow passage 52U, which is formed in the upstream-side member 6A, on the connection face 74A side thereof and the opening of the downstream flow passage 52D, which is formed in the coupling part 96A, on the connection face 965 side thereof have the same shape. Accordingly, by assembling the main body 51 as described above, the inner wall face of the upstream flow passage 52U and the inner wall face of the downstream flow passage 52D become flush with each other to form one pump flow passage 52 that is coaxial with the axis line O.

Next, a description is given of the specific configuration of the pump flow passage 52 formed inside the main body 51A. The venturi 53 which decreases in diameter toward downstream in the flow direction F1 is formed in the pump flow passage 52 at a position downstream of the first inlet pipe 62 in the flow direction F1. The venturi 53 is formed along the axis line O over a predetermined length extending from the largest diameter part 54 which is the largest in inner diameter to the smallest diameter part 55 which is the smallest in inner diameter. In addition, as illustrated in FIG. 8, the smallest diameter part 55 is disposed downstream of the distal end face 64*a* of the first inlet pipe 62 in the flow direction F1 while the largest diameter part 54 is disposed upstream of the distal end face 64*a* of the first inlet pipe 62 in the flow direction F1. Further, the distal end face 64*a* of the first inlet pipe 62 is disposed at substantially the same position as the connection faces 74A, 965 of the upstream-side member 6A and the coupling part 96A along the axis line O. Besides, the smallest diameter part 55 of the venturi 53 is disposed downstream of the connection faces 74A, 565 of the upstream-side member 6A and the coupling part 96A in the flow direction F1 due to the same reason as in the first embodiment.

Third Embodiment

Next, a third embodiment of the present invention is described with reference to the drawings. An evaporative fuel processing device according to this embodiment differs from the evaporative fuel processing device 2 according to the first embodiment in the configuration of a purge pump. Note that, in the following description, the same constituents as those of the first embodiment are given the same reference numerals and the description thereof is omitted.

Figure 9:
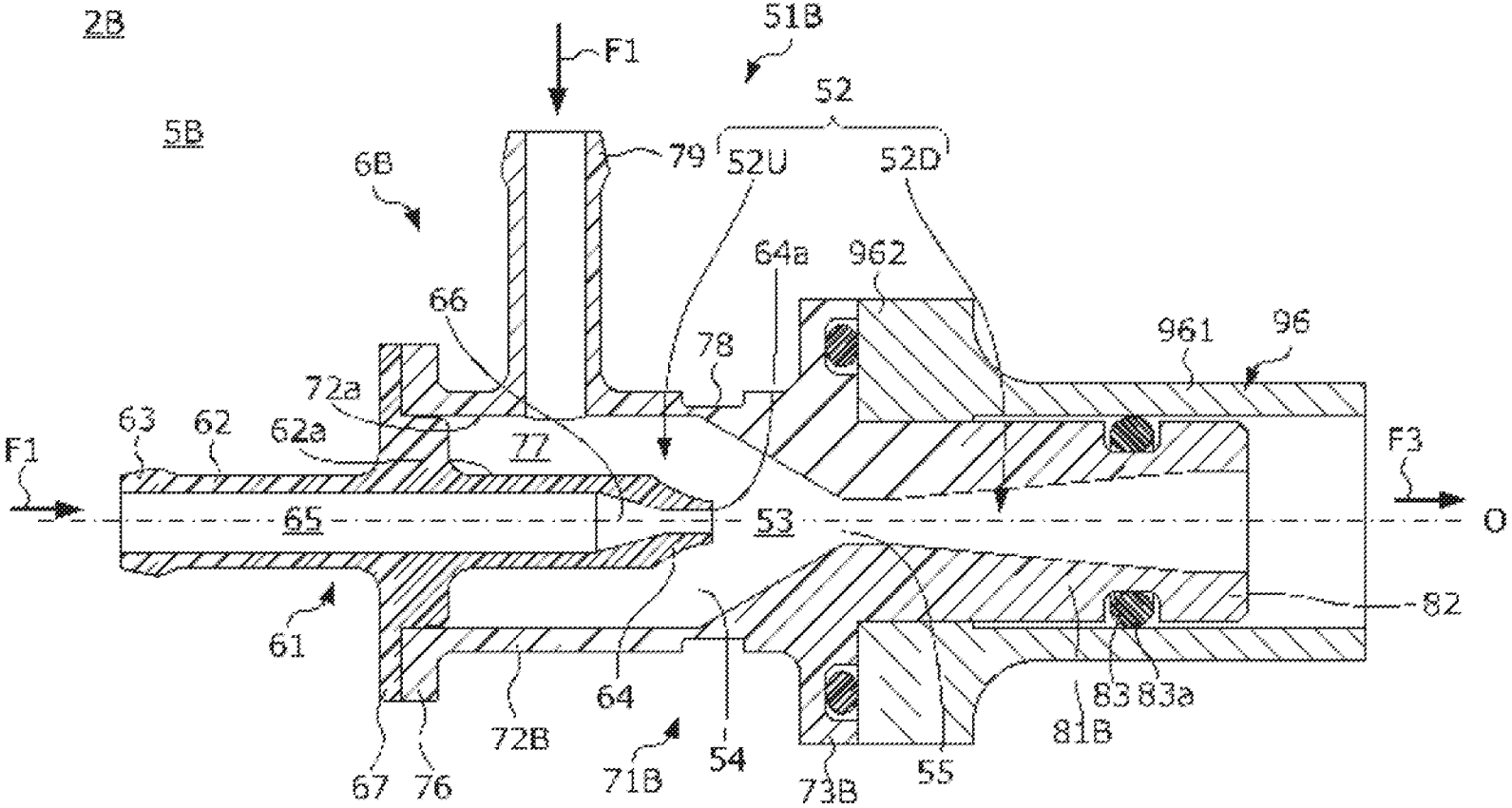
FIG. 9 is a sectional view of a purge pump used in an evaporative fuel processing device according to a third embodiment of the present invention.

FIG. 9 is a sectional view of a purge pimp 5B used in an evaporative fuel processing device 2B according to this embodiment. A main body 51B of the purge pump 5B is in the form of a cylinder extending along the axis line O, and the pump flow passage 52 extending along the axis line O is formed inside the main body. The main body 51B of the purge pump 5B is composed of: an upstream part 6B which constitutes the upstream side in the flow direction F1; and a discharge pipe 81B which constitutes the downstream side in the flow direction F1. The main body 51B is made of resin, for example. Unlike the main body 51 of the purge pump 5 in the first embodiment, the upstream part 6B and the discharge pipe 81B are integrally formed by injection molding, for example.

The downstream flow passage 52D which constitutes the downstream side of the pump flow passage 52 is formed inside the discharge pipe 81B. The discharge pipe 81B is in the form of a cylinder extending along the axis line O.

The upstream part 6B is constituted by combining: the first member 61 in which the first inlet pipe 62 is formed; and a second member 71B in which the second inlet pipe 79 is formed. The configuration of the first member 61 is the same as that in the first embodiment.

The second member 71B includes: a central tubular part 72B which is in the form of a tube extending along the axis line O; the second inlet pipe 79 which is disposed at substantially the center of this central tubular part 72B along the axis line O; and a flange part 73B which is disposed on the discharge pipe 81B side of the central tubular part 72B. The upstream flow passage 52U which constitutes the upstream side of the pump flow passage 52 is formed inside the central tubular part 72B.

The flange part 73B is in the form of a brim extending perpendicular to the axis line O. As illustrated in FIG. 9, the flange part 73B has substantially the same shape as the flange part 962 of the coupling part 96. The main body 51B of the purge pump 5B is secured on the coupling part 96 by pressing the discharge pipe 81B into the tubular part 961 of the coupling part 96 along the axis line O until the flange part 73B of the main body 51B comes into contact with the flange part 962 of the coupling part 96 and then fastening the flange part 73B and the flange part 962 with bolts (not illustrated).

In addition, a fragile part 78 which is less rigid than other parts is formed in the central tubular part 71B at a position between the second inlet pipe 79 and the flange part 73B. The fragile part 78 is formed by, for example, notching the central tubular part 71B at a position between the second inlet pipe 79 and the flange part 73B annularly along its outer circumferential face and thereby reducing the thickness thereof as compared with other parts.

Here, the position where the fragile part 78 is provided is described in more detail. When some sort of impact is applied on the main body 51B, the fragile part 78 of the main body 51B is preferentially broken. Further, the breakage of the fragile part 78 of the main body 51B makes the pump flow passage 52, formed inside the main body 51B, communicate with the outside air and therefore evaporative fuel fed from the canister 32 to the pump flow passage 52 through the second inlet pipe 7S might flow out through the broken part. To cope with this, the fragile part 78 is disposed at such a position that the Venturi effect in the pump flow passage 52 disappears or decreases if such a failure occurs in the main body 51B.

More specifically, the fragile part 78 is disposed upstream of the smallest diameter part 55 of the venturi 53 in the flow direction F1. Thereby, if the fragile part 78 of the main body 51B is broken, the air having flowed out from the distal end face 64*a* of the first inlet pipe 62 flows out to the outside air through the broken fragile part 78 before the sectional area of its flow passage is narrowed down enough by the venturi 53, so that the Venturi effect hardly occurs or decreases. For this reason, even if the air flows out from the distal end face 64*a* of the first inlet pipe 62 during supercharging, the airflow from the canister 32 to the second inlet pipe 79 hardly occurs, whereby it is possible to inhibit evaporative fuel from flowing out through the broken fragile part 78. Note that, in consideration of the manufacturability of the purge pump 5B, it is preferable that the fragile part 78 is formed in the central tubular part 71B at substantially the same position as the distal end face 64*a* of the first inlet pipe 62 along the axis line O.

The invention claimed is:

1. An evaporative fuel processing device comprising:

a canister provided with an absorbing agent configured to absorb evaporative fuel;

a purge pump and a supercharger each disposed in an intake passage of an internal combustion engine, said purge pump having a cylindrical body and comprising:

a discharge part that communicates with said intake passage at a position upstream of said supercharger;

a first inlet part through which a fluid is introduced from the intake passage downstream of said supercharger;

a second inlet part through which a fluid is introduced from said canister; and a pump flow passage formed in said cylindrical body and having a flow direction of said fluids introduced through said first and second inlet parts, said pump flow passage extending in said flow direction and being configured to discharge said fluids introduced through said first and second inlet parts into said intake passage through said discharge part;

a bypass passage connecting a part of said intake passage downstream of said supercharger and said first inlet part in fluid communication with each other; and a purge passage connecting said canister and said second inlet part in fluid communication with each other, wherein said pump flow passage has a narrowing down part which decreases in diameter toward downstream of said flow direction, said narrowing down part, being located at a position downstream of said first inlet part in said flow direction and having a smallest diameter part at which an inner diameter of said narrowing down part is the smallest, and said cylindrical body has a fragile part formed at a position upstream of said smallest diameter part of said narrowing down part in said flow direction.

2. An evaporative fuel processing device comprising:

a canister provided with an absorbing agent configured to absorb evaporative fuel;

a purge pump and a supercharger each disposed in an intake passage of an internal combustion engine, said purge pump having a cylindrical body comprising:

a discharge part, that communicates with said intake passage at a position upstream of said supercharger;

a first inlet part through which a fluid is introduced from the intake passage downstream of said supercharger;

a second inlet part through which a fluid is introduced from said canister; and a pump flow passage formed in said cylindrical body and having a flow direction of said fluids introduced through said first and second inlet parts, said pump flow passage extending in said flow direction and being configured to discharge said fluids introduced through said first and second inlet parts into said intake passage through said discharge part;

a bypass passage connecting a part of said intake passage downstream of said supercharger and said first inlet part in fluid communication with each other; and a purge passage connecting said canister and said second inlet part in fluid communication with each other, wherein said pump flow passage has a narrowing down part which decreases in diameter toward downstream of said flow direction, said narrowing down part being located at a position downstream of said first inlet part in said flow direction and having a smallest diameter part at which an inner diameter of said narrowing down part is the smallest, said cylindrical body comprises an upstream part in which said first inlet part is disposed and a downstream part in which said discharge part is disposed, and a connection part at which said upstream part and said downstream part are connected to each other is disposed upstream of said smallest diameter part of said narrowing down part.

3. The evaporative fuel processing device according to claim 1, wherein said first inlet part has a nozzle whose proximal end part is connected to said bypass passage and whose distal end part is exposed inside of said pump flow passage, said cylindrical body has a tubular part which is coaxial with an axis line of said first inlet part and covers an outer circumferential face of said distal end part, a gap part is formed between said outer circumferential face and an inner wall surface of said tubular part, said purge passage communicates with said gap part through said second inlet part, and said smallest diameter part is formed downstream of the distal end part of said first inlet part in said flow direction.

4. The evaporative fuel processing device according to claim 2, wherein said downstream part of said cylindrical body is formed integrally with an intake pipe in which said intake passage is formed.

5. The evaporative fuel processing device according to claim 2, wherein said first inlet part has a nozzle whose proximal end part is connected to said bypass passage and whose distal end part is exposed inside of said pump flow passage, said cylindrical body has a tubular part which is coaxial with an axis line of said first inlet part and covers an outer circumferential surface of said distal end part, a gap part is formed between said outer circumferential face and an inner wall face of said tubular part, said purge passage communicates with said gap part through said second inlet part, and said smallest diameter part is formed downstream of the distal end part of said first inlet part in said flow direction.

6. The evaporative fuel processing device according to claim 1, further comprising:

a purge control valve which is disposed in said purge passage and configured to connect or disconnect said canister and said second inlet part;

a pressure sensor which is configured to detect pressure in said purge passage or in said canister; and an anomaly judgment unit which is configured to judge whether there is an anomaly in said purge pump based on a detection signal from said pressure sensor.

7. The evaporative fuel processing device according to claim 3, wherein said fragile part is formed in said cylindrical body at substantially the same position as a distal end face of said first inlet part along said axis line.

8. The evaporative fuel processing device according to claim 5, wherein said connection part is disposed at substantially the same position as a distal end face of said first inlet part along said axis line.

9. A fluid processing device comprising a cylindrical body having a discharge part, a first inlet part, a second inlet part, and a pump flow passage which has a flow direction of fluids introduced through said first and second inlet parts, said pump flow passage extending in said flow direction, such that the fluid processing device discharges the fluids introduced through said first and second inlet parts through said discharge part, wherein said first inlet part and said discharge part are arranged in said cylindrical body at positions opposed to each other in said flow direction, said pump flow passage has a narrowing down part which decreases in diameter toward downstream of said flow direction, said narrowing down part being located at a position downstream of said first inlet part in said flow direction and having a smallest diameter part at which an inner diameter of said narrowing down part is the smallest, and said cylindrical body has a fragile part at a position upstream of said smallest diameter part in said flow direction.

10. A fluid processing device comprising a cylindrical body having a discharge part, a first inlet part, a second inlet part, and a pump flow passage which has a flow direction of fluids introduced through said first and second inlet parts, said pump flow passage extending in said flow direction, such that the fluid processing device discharges the fluids introduced through said first and second inlet parts through said discharge part, wherein said first inlet part and said discharge part are arranged in said cylindrical body at positions opposed to each other in said flow direction, said pump flow passage has a narrowing down part which decreases in diameter toward downstream of said flow direction, said narrowing down part being located at a position downstream of said first inlet part in said flow direction and having a smallest diameter part at which an inner diameter of said narrowing down part is the smallest, said cylindrical body comprises an upstream part, in which said first inlet part is disposed and a downstream part in which said discharge part is disposed, and a connection part at which said upstream part and said downstream part are connected to each other is disposed upstream of said smallest diameter part in said flow direction.

* * * * *